US006694553B1

(12) United States Patent
Yates

(10) Patent No.: US 6,694,553 B1
(45) Date of Patent: Feb. 24, 2004

(54) BASELESS CUSHION

(76) Inventor: Paul M. Yates, 5814 Briar Tree Dr., La Canada, CA (US) 91011

( * ) Notice: Subject to any disclaimer, the term of this patent is extended or adjusted under 35 U.S.C. 154(b) by 0 days.

(21) Appl. No.: 10/226,009

(22) Filed: Aug. 21, 2002

(51) Int. Cl.[7] ..... A61F 7/00; A47F 5/00

(52) U.S. Cl. ..... 5/655.5; 5/654; 5/646; 5/909

(58) Field of Search ..... 5/655.5, 654, 644, 5/909, 646; 248/118, 118.1

(56) References Cited

U.S. PATENT DOCUMENTS

| | | | | |
|---|---|---|---|---|
| 3,239,478 | A | | 3/1966 | Harlan, Jr. |
| 3,265,765 | A | | 8/1966 | Holden |
| 3,676,387 | A | | 7/1972 | Lindlof |
| 5,170,971 | A | * | 12/1992 | Schaeffer et al. ..... 248/118.1 |
| 5,679,193 | A | | 10/1997 | Yates |
| 5,713,544 | A | | 2/1998 | Wolf et al. |
| 5,756,184 | A | * | 5/1998 | Yates ..... 428/188 |
| 5,803,416 | A | * | 9/1998 | Hanson et al. ..... 248/118 |
| 5,932,046 | A | | 8/1999 | Yates |
| 5,980,143 | A | * | 11/1999 | Bayer et al. ..... 400/715 |
| 5,993,584 | A | | 11/1999 | Yates |
| 6,017,407 | A | | 1/2000 | Yates |
| 6,027,674 | A | | 2/2000 | Yates |
| 6,048,602 | A | | 4/2000 | Yates |
| 6,050,964 | A | | 4/2000 | Yates |
| 6,089,516 | A | | 7/2000 | Yates |
| 6,117,259 | A | | 9/2000 | Yates |
| 6,219,867 | B1 | | 4/2001 | Yates |
| 6,290,794 | B1 | | 9/2001 | Yates |
| 6,314,598 | B1 | | 11/2001 | Yates |
| 6,319,441 | B1 | | 11/2001 | Yates |
| 6,328,266 | B1 | | 12/2001 | Yates |

* cited by examiner

*Primary Examiner*—Teri Pham Luu
*Assistant Examiner*—Fredrick Conley
(74) *Attorney, Agent, or Firm*—Walter A. Hackler

(57) ABSTRACT

A baseless cushion includes a pad with a layer of stable elastomeric block polymer gel with a pad having an opposite top and bottom surfaces, opposite longitudinally extending sides and opposite longitudinally spaced ends. A frame is provided for supporting the pad only along the, spaced ends or sides thereof.

8 Claims, 2 Drawing Sheets

BASELESS CUSHION

Present invention generally relates to cushion articles and is more particularly directed to wrist support gel cushions for use along the front edges of devices to be operated by a users hands or fingers, such as, for example, in front of a computer keyboard, computer mouse or other input device.

The operation of equipment, particularly keyboards and the like, for extended periods of time often causes posture and stress related injuries. Stress injuries to the wrist by repetitive motion, such as carpal tunnel syndrome, may occur due to the operation of computer keyboards and mouse devices.

Often, when manipulating a computer keyboard or computer mouse, a user's wrist is held for extended periods of time in a bent position over and away from a supporting surface.

Many types of wrist rest have been developed to prevent stress related injuries of computer keyboard and mouse users by supporting the wrist in a position in front of the device so that bending of the wrist is decreased which decreases the stress caused by relative motion. The use of such devices may also contribute to the stress if utilized on an uneven surface. An uneven surface may provide instability to the wrist rest which may also lead to stress on the user over extended periods of time.

Present invention provides for a baseless cushion which includes the advantages of a gel support along with the stability of a frame for facilitating placement and use of the cushion.

SUMMARY OF THE INVENTION

A baseless cushion in accordance with the present invention generally includes a pad comprising a layer of stable elastomeric block polymer gel with the pad having opposite top and bottom surfaces opposite longitudinally extending sides and a opposite longitudinally spaced ends. A frame is provided for supporting the pad only along the pad ends and/or sides.

More particularly, the pad may includes elongate tubular layer flexible material around the gel with the tubular layer being closed at the ends of the pad. The closed ends of the pad may form tabs extending outwardly from the pad and the frame includes means for securing the tabs to the frame. In addition, the pad and the frame may be configured for supporting the cushion sides. In that regard, the pad sides may include tabs extending from the tubular layer for securement to the frame.

In one embodiment of the present invention, a plurality of pads is provided with each pad comprising a layer of stable elastomer block polymer gel. Each of the pads includes a opposite top and bottom surfaces, opposite longitudinally extending sides and opposite longitudinally spaced ends. Adjoining pad sides may be interconnected, preferably by a web.

Each pad may comprise an elongate tubular layer of flexible material around respective gels with tubular layer being closed at ends of each pad. Further, the tubular layers may be closed along tabs respectively extending outwardly from the ends of the pads and the frame includes means for securing the tabs to the frame.

BRIEF DESCRIPTION OF THE DRAWINGS

The advantages and features of the present invention will be better understood by the following description when considered in conjunction with the accompanying drawings, in which.

DETAILED DESCRIPTION

Preferably the gel is a stable elastomeric block polymer gel similar to the gel described in U.S. Pat. No. 3,676,387, the gels are polymer-oil combinations. The polymers are the A-B-A configurations wherein each block A is a glassy or resinous non-elastomeric thermoplastic polymer block with a glass transition temperature above room temperature, i.e., 25° C., having an average molecular weight of between about 2,000 and 100,000 and which is relatively incompatible with the elastomeric polymer block B. B is an elastomeric polymer block of a conjugated diene, the average molecular weight between about 15,000 and about 1,000,000 (preferably 15,000 to 250,000) and having a glass transition temperature between that of blocks A.

Figure 1:
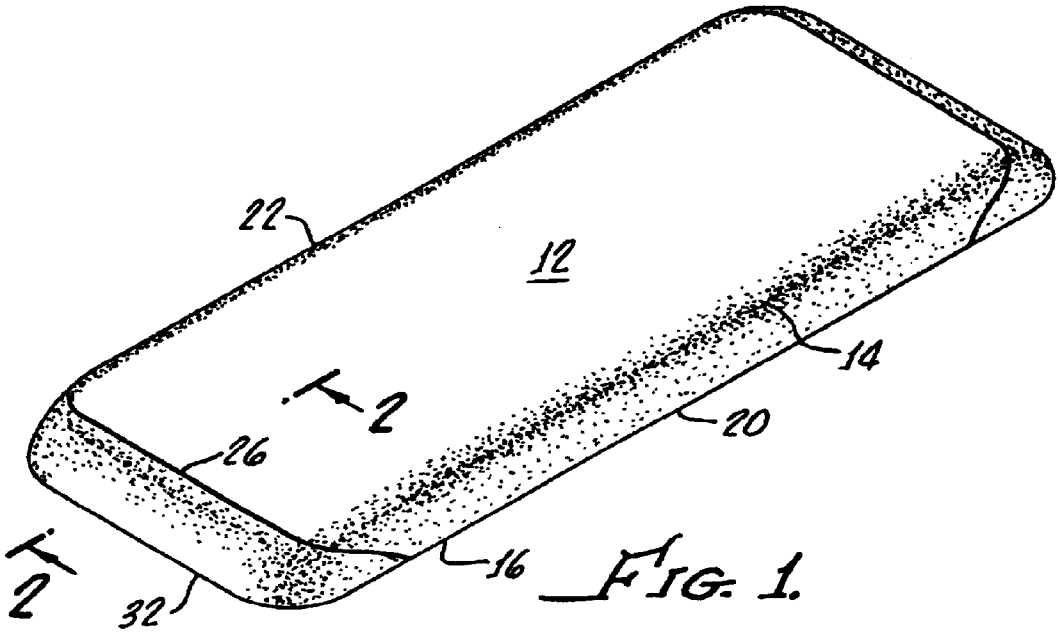
FIG. 1 is a perspective view of the baseless cushion in accordance with the present invention generally showing a pad and a frame for supporting the pad only along the spaced apart end.
Figure 2:
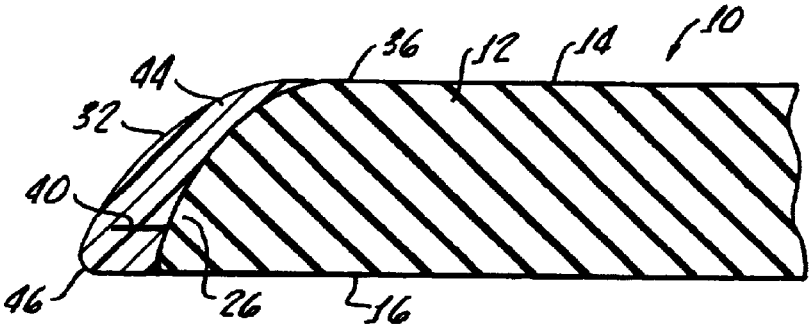
FIG. 2 is a side view of the cushion shown in FIG. 1 in more particularly showing an elongate tubular member of flexible material surrounding a gel with the tubular layer being closed into tabs at ends of the pad with the tabs supported by the frame.

The end blocks A of the block copolymer should constitute approximately 10 to 50 percent of the total polymer weight. Such block polymers and a method for their formation, are described in U.S. Pat. No. 3,265,765 (Holden et al.) issued Aug. 9, 1966, and in, general, these are quite suitable in the practice of the present invention. With reference to FIGS. 1 and 2, there is shown a baseless cushion 10 in accordance with the present invention generally including a pad 12 comprising a layer of stable elastomeric block polymer gel as hereinabove described and having opposite top 14 and bottom 16 surfaces along with opposite longitudinally extending sides 20, 22 and longitudinally spaced ends 26. A frame 32 is provided for supporting the pad 12 only along the ends 26.

In that regard, the pad 12 may comprise an elongate tubular layer of any suitable flexible material 36, which is closed at the ends 26 of the pad. Preferably, the tubular layer 36 is closed along a tab, or tail, 40, which extend outwardly from the pad ends 26.

The frame 32 includes means for securing the tabs 40 to the frame 32. As shown, this means may include injection molding a frame top 44 to a frame bottom 46 with the tab 40 therebetween, see FIG. 2.

Figure 3:
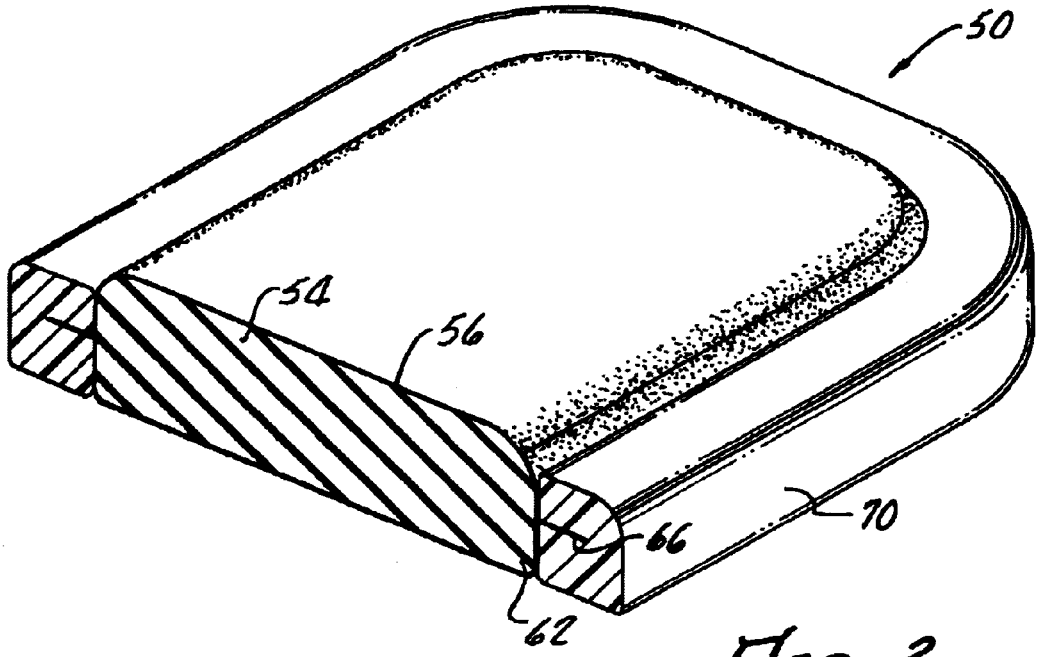
FIG. 3 is an alternative embodiment of the present invention partially broken away showing a pad including side tabs extending from a tubular layer with side tabs secured to the frame.

Alternatively, the means could include any other clamping, screwing, riveting, welding, or gluing the structure for securing the tab 40 to the frame 32. With reference to FIG. 3, there is shown an alternative cushion 50 embodiment of the present invention which includes a pad 52 comprising a gel 54 with a tubular layer 56 of flexible material around the gel additionally closed along side 62 by way of tabs 66 as hereinabove described in connection with the cushion 10.

The tabs 66 may be, for example, injection molded into a frame 70 also as hereinabove described.

Figure 4:
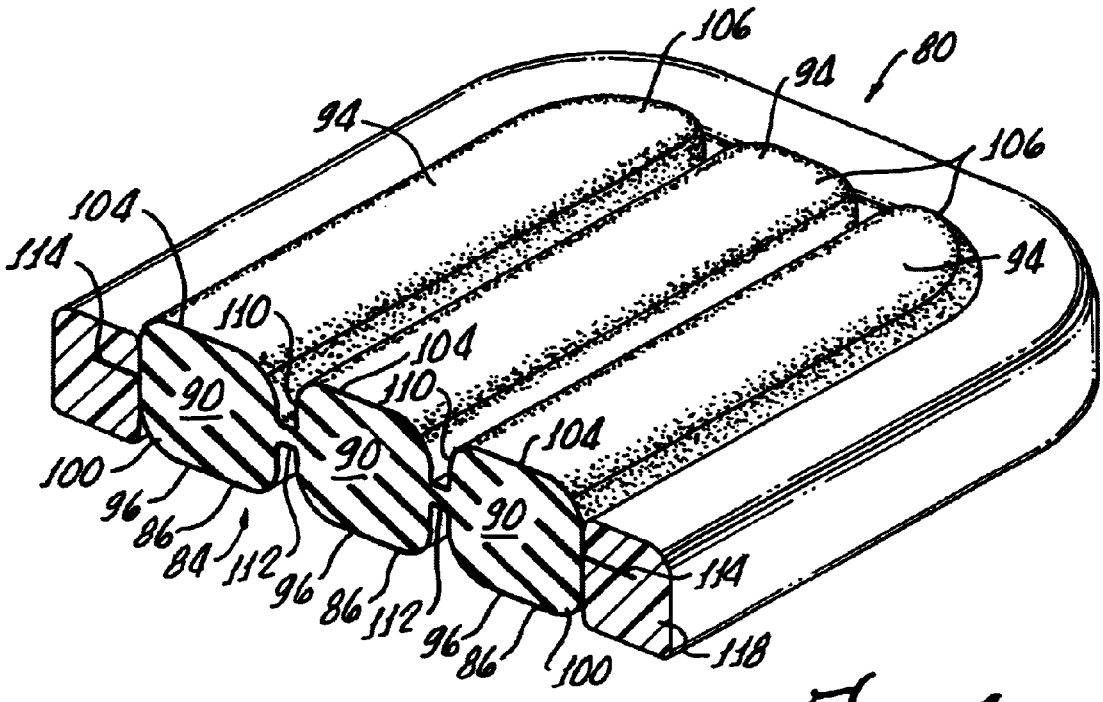
FIG. 4 is a perspective view of an alternative embodiment in accordance with the present invention partially cut away illustrating a cushion having a plurality of parallel pads.

With reference to FIG. 4, there is shown yet another cushion 80 embodiment in accordance with the present invention in which a cushion 84 includes a plurality of parallel pads 86 with each pad 86 comprising a layer of stable elastomeric block polymer gel 90 with each pad 86 having top 94 and bottom 96 surfaces with longitudinally extending sides 100. Each of the pads 86 include tubular layers 104, which are closed at ends 106 of the pads 86 in a manner hereinabove described.

As shown, the pads 86 are interconnected at pad sides 110 and are interconnected by webs 112. The sides 100 include side tabs 114 which may be secured to a frame 118 by injection molding the side tabs 114 thereinto.

It should be appreciated that each of the cushions 10, 50, 82 and pads 12, 52, 86 may be formed with the apparatus and methods described in U.S. Pat. Nos. 5,679,193, 5,756,184, 5,932,046, 5,993,584, 6,017,407, 6,027,674, 6,048,602, 6,050,964, 6,089,516, 6,117,259, 6,219,867, 6,290,794, 6,314,598, 6,319,441 and 6,328,266 all to Yates and all to be incorporated herein by this specific reference thereto for describing apparatus and methods for manufacture of the cushion in accordance with the present invention.

Although there has been hereinabove described a specific cushion in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclose herein. Accordingly, any and all modifications, variations or equivalent arrangements which may occur to those skilled in the art, should be considered to be within the scope of the present invention as defined in the appended claims.

What is claimed is:

1. A baseless cushion comprising:

a pad comprising a layer of stable elastomeric block polymer gel, said pad having opposite top and bottom surfaces, opposite longitudinally extending sides and opposite longitudinally spaced, ends said pad including an elongate tubular layer of flexible material around the gel, said tubular layer being closed at the ends of said pad along tabs extending outwardly from the pad ends and;

a frame for supporting said pad only along the spaced ends, said frame includes means for securing said tabs to said frame.

2. The cushion according to claim 1 wherein the frame further supports the cushion sides.

3. The cushion according to claim 2 wherein the pad sides include side tabs extending from the tubular layer and said frame further comprises means for securing said side tabs to said frame.

4. The cushion according to claim 1 further comprising a plurality of paralleled pads, each pad comprising a layer of stable elastomeric block polymer gel, each pad having opposite top and bottom surfaces opposite longitudinally extending sides and opposite longitudinally spaced ends, each pad comprising an elongate tubular layer of flexible natural around respective gels, the tubular layer being closed at the ends of each pad along tabs respectively extending outwardly from the ends of the pads and said frame includes means for securing said tabs to said frame.

5. The cushion according to claim 4 wherein adjoining pad sides are interconnected.

6. The cushion according to claim 5 wherein adjoining pad sides are interconnected by a web.

7. The cushion according to claim 4 wherein the frame further supporting outboard sides of the pads.

8. The cushion according to claim 7 wherein the outboard pad sides include side tabs extending therefrom and said from further comprises means for receiving said side tabs to said frame.

* * * * *